US009050848B2

(12) United States Patent
Tsai

(10) Patent No.: US 9,050,848 B2
(45) Date of Patent: Jun. 9, 2015

(54) COMBINATION CLASSIFICATION SHELF

(71) Applicant: DONGGUAN MASTER UNITED PLASTIC & HARDWARE PRODUCTS CO., LTD., Ching-Hsi Town, Dongguan (CN)

(72) Inventor: Tsung-Yu Tsai, Changhua (TW)

(73) Assignee: DONGGUAN MASTER UNITED PLASTIC & HARDWARE PRODUCTS CO., LTD., Dongguan, Guandong Province (CN)

( * ) Notice: Subject to any disclaimer, the term of this patent is extended or adjusted under 35 U.S.C. 154(b) by 99 days.

(21) Appl. No.: 14/028,013

(22) Filed: Sep. 16, 2013

(65) Prior Publication Data

US 2015/0076086 A1 Mar. 19, 2015

(51) Int. Cl.

| | |
|---|---|
| ***A47F 3/14*** | (2006.01) |
| ***B42F 7/10*** | (2006.01) |
| ***A47F 7/00*** | (2006.01) |
| ***A47F 5/10*** | (2006.01) |
| ***A47F 5/13*** | (2006.01) |
| *A47F 5/00* | (2006.01) |
| *A47G 29/087* | (2006.01) |
| *A47F 5/01* | (2006.01) |

(52) U.S. Cl.

CPC ..... *B42F 7/10* (2013.01); *A47F 7/0042* (2013.01); *A47F 5/101* (2013.01); *A47F 5/132* (2013.01); *A47F 3/14* (2013.01); *A47F 5/01* (2013.01); *A47F 5/0025* (2013.01); *A47F 5/005* (2013.01)

(58) Field of Classification Search

CPC ..... A47F 5/132; A47F 5/101; A47F 5/0025; A47F 5/01; A47F 5/005; A47F 3/14; A47F 7/0042; A47B 57/58; A47B 57/581; A47B 57/586; A47B 96/04; A47B 65/15; B42F 7/10; B42F 7/12; B42F 7/00; B42F 17/08

USPC ..... 211/184, 181.1, 126.1, 126.2, 126.5, 211/126.9, 126.13, 11, 119.005; 312/330.1, 312/280, 183, 193; 220/495, 23.83, 23.86, 220/23.88, 485, 486, 489; 206/425, 371

See application file for complete search history.

(56) References Cited

U.S. PATENT DOCUMENTS

| | | | | | |
|---|---|---|---|---|---|
| 910,057 | A | * | 1/1909 | Greener | 248/175 |
| 1,277,827 | A | * | 9/1918 | Barber | 135/137 |
| 1,386,878 | A | * | 8/1921 | Lamp | 211/126.11 |
| 1,544,920 | A | * | 7/1925 | Manley et al. | 312/183 |
| 1,881,614 | A | * | 10/1932 | Irving | 211/11 |
| 2,056,683 | A | * | 10/1936 | Mattman | 211/11 |

(Continued)

*Primary Examiner* — Joshua J Michener
*Assistant Examiner* — Devin Barnett
(74) *Attorney, Agent, or Firm* — Muncy, Geissler, Olds & Lowe, P.C.

(57) ABSTRACT

A combination classification shelf includes a base frame and at least one shelf divider. The base frame includes two support rod members transversely arranged in parallel. The shelf divider is detachably mounted at the base frame. The shelf divider is bent to from two classification rod members and two transverse rod members. Each classification rod member has two hooked end portions. The transverse rod members are respectively connected between the classification rod members and define with the hooked end portions of the respective classification rod members a respective receiving space. The support rod members are respectively positioned in the respective receiving spaces. The transverse rod members are respectively supporting the support rod members. Thus, the shelf dividers will be not fall easily.

11 Claims, 9 Drawing Sheets

(56) References Cited

U.S. PATENT DOCUMENTS

| | | | | | |
|---|---|---|---|---|---|
| 2,575,919 | A | * | 11/1951 | Kautzmann et al. | 211/126.12 |
| 2,889,054 | A | * | 6/1959 | Wheeler | 211/153 |
| 2,901,120 | A | * | 8/1959 | Abrahamson | 211/126.12 |
| 2,916,161 | A | * | 12/1959 | Schaefer | 211/126.2 |
| 3,269,547 | A | * | 8/1966 | Chamberlin | 211/11 |
| 3,739,918 | A | | 6/1973 | Kreitzburg | |
| 3,874,510 | A | * | 4/1975 | Perry et al. | 211/126.5 |
| 4,023,682 | A | | 5/1977 | Niece | |
| 4,560,073 | A | * | 12/1985 | King | 211/184 |
| 4,872,580 | A | * | 10/1989 | Fuller et al. | 211/45 |
| D343,075 | S | * | 1/1994 | Cappel, III | D6/462 |
| 5,996,812 | A | * | 12/1999 | Sokol, Jr. | 211/11 |
| 6,116,436 | A | * | 9/2000 | Ferrucci et al. | 211/187 |
| 6,161,708 | A | * | 12/2000 | Myler | 211/90.02 |
| 6,273,276 | B1 | * | 8/2001 | Upton et al. | 211/59.2 |
| 6,837,387 | B2 | * | 1/2005 | De La Fuente | 211/181.1 |
| D555,203 | S | * | 11/2007 | Goodman et al. | D19/90 |
| D613,965 | S | * | 4/2010 | Tertel et al. | D6/462 |
| 7,950,537 | B1 | | 5/2011 | Goodman et al. | |
| 8,579,121 | B2 | * | 11/2013 | Eng et al. | 211/41.9 |
| D717,371 | S | * | 11/2014 | Tsai | D19/90 |
| D719,610 | S | * | 12/2014 | Tsai | D19/90 |
| 2004/0089625 | A1 | * | 5/2004 | Tsai | 211/126.2 |
| 2009/0145869 | A1 | * | 6/2009 | Battaglia | 211/153 |
| 2014/0217876 | A1 | * | 8/2014 | Tsai | 312/334.44 |
| 2014/0265779 | A1 | * | 9/2014 | Tsai | 312/286 |

* cited by examiner

COMBINATION CLASSIFICATION SHELF

BACKGROUND OF THE INVENTION

1. Field of the Invention

The present invention relates to a rod-based document shelves, and more particularly to a combination classification shelf for holding classified documents or the like.

2. Description of the Related Art

U.S. Pat. No. 7,950,537 discloses a ventilated shelf divider, which comprises a downwardly opening frame assembly including laterally diverging wire walls that are releasably mountable to laterally spaced shelf wires. Due to the arrangement of the central top element, the ventilated shelf divider can simply be used as partition means and cannot provide sufficient storage space for document classification.

U.S. Pat. Nos. 4,023,682 and 3,739,918 provide similar holder devices for holding containers or bolts of cloth in a classified manner. However, the formation of the lower ends of these two holder device designs requires multiple bending processing steps, complicating the manufacturing process and increasing the manufacturing time and cost.

SUMMARY OF THE INVENTION

The present invention has been accomplished under the circumstances in view. It is the main object of the present invention to provide a combination classification shelf, which comprises a base frame and at least one shelf divider. The base frame comprises two support rod members transversely arranged in parallel and kept apart from each other at a distance. The at least one shelf divider is detachably mounted at the base frame. Each shelf divider comprises two classification rod members and two transverse rod members. Each classification rod member comprises a horizontal top portion, two vertical lateral portions and two hooked end portions. The horizontal top portion is disposed at top ends of the vertical lateral portions. The vertical lateral portions are disposed opposite to each other. The hooked end portions are respectively disposed at bottom ends of the vertical lateral portions. The two transverse rod members are respectively connected between respective bottom ends of the vertical lateral portions of the classification rod members adjacent to the hooked end portions. Each transverse rod member defines with the respective hooked end portions a receiving space. The two support rod members are respectively received in the two receiving spaces. Further, the two transverse rod members are respectively stopped at respective top surfaces of the two support rod members. Thus, when compared with the prior art designs, the shelf dividers of the combination classification shelf are easily to make. After mounted at the base frame, the shelf dividers do not fall easily.

In another embodiment of the present invention, the combination classification shelf comprises a drawer assembly, a base frame, and at least one shelf divider. The base frame is detachably mounted at the drawer assembly, comprising two support rod members transversely arranged in parallel and kept apart from each other at a distance. The at least one shelf divider is detachably mounted at said base frame. Each shelf divider comprises two classification rod members and two transverse rod members. Each classification rod member comprises a horizontal top portion, two vertical lateral portions and two hooked end portions. The horizontal top portion is disposed at top ends of the vertical lateral portions. The vertical lateral portions are disposed opposite to each other. The hooked end portions are respectively disposed respective bottom ends of the vertical lateral portions. The two transverse rod members are respectively connected between respective bottom ends of the vertical lateral portions of the classification rod members adjacent to the hooked end portions. Each transverse rod member defines with the respective hooked end portions a receiving space. The two support rod members are respectively received in the two receiving spaces. Further, the two transverse rod members are respectively stopped at respective top surfaces of the two support rod members. Thus, when compared pared with the prior art designs, the shelf dividers of the combination classification shelf are easily to make. Thus, the combination classification shelf of this embodiment provides extra spaces for holding documents.

Preferably, the two support rod members are square rods, and the two transverse rod members are square rods too. Thus, the two transverse rod members can be positively rested on the top surfaces of the support rod members to enhance the support between the two support rod members and the two transverse rod members.

Other advantages and features of the present invention will be fully understood by reference to the following specification in conjunction with the accompanying drawings, in which like reference signs denote like components of structure.

DETAILED DESCRIPTION OF THE INVENTION

Figure 1:
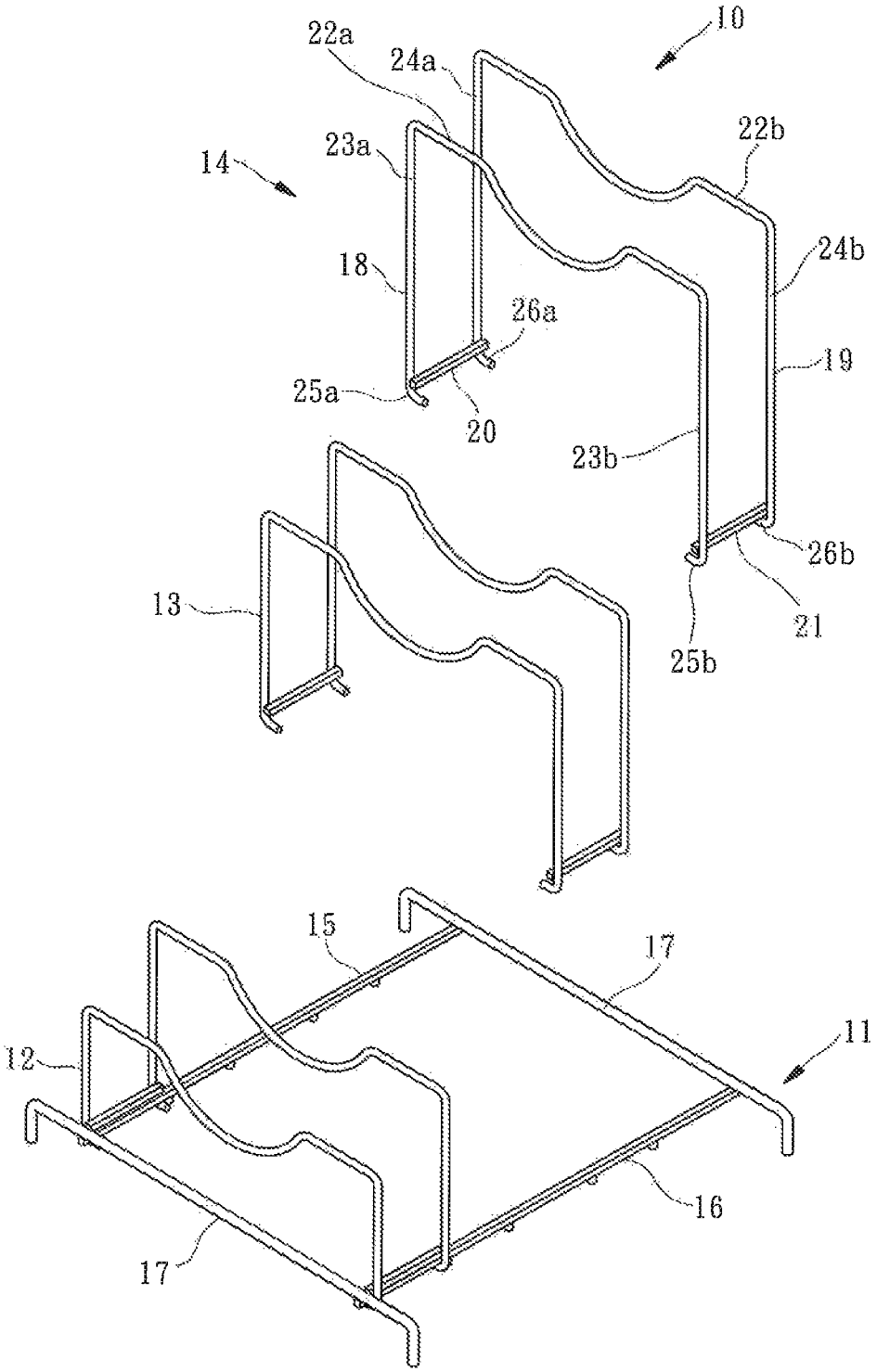
FIG. 1 is an exploded view of a combination classification shelf in accordance with a first embodiment of the present invention.
Figure 2:
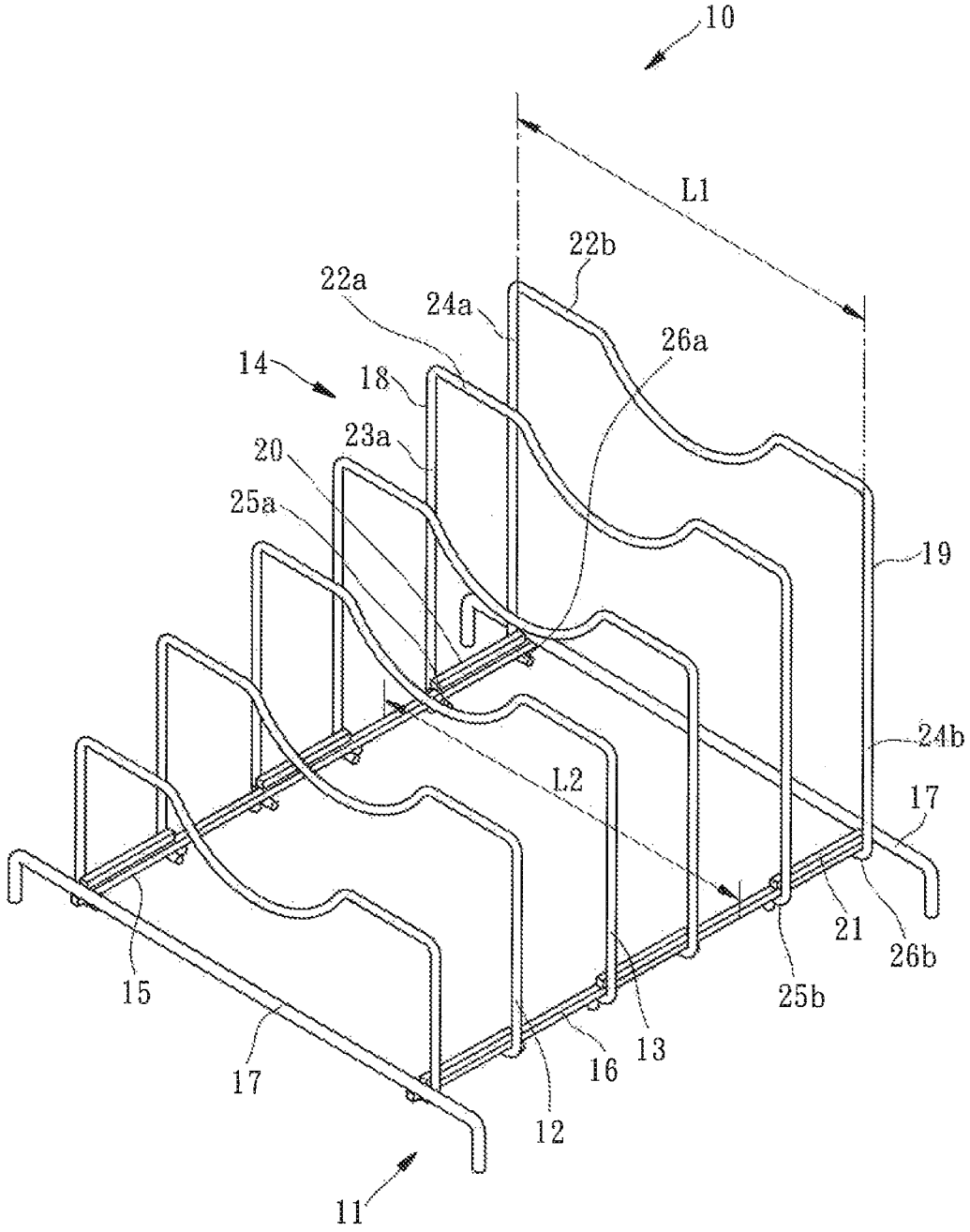
FIG. 2 is an elevational assembly view of the combination classification shelf shown in FIG. 1.

Referring to FIGS. 1 and 2, a combination classification shelf in accordance with a first embodiment of the present invention is shown. The combination classification shelf 10 comprises a base frame 11, and three shelf dividers 12, 13, 14. These shelf dividers 12, 13, 14 are respectively detachably mounted at the base frame 11. The base frame 11 and the shelf dividers 12, 13, 14 are preferably made of metal material.

The base frame 11 comprises two support rod members 15, 16, and two connection rod members 17. The two support rod members 15, 16 are transversely kept apart at a predetermined distance in a parallel manner, and connected between the two connection rod members 17. The two support rod members 15, 16 and the two connection rod members 17 are preferably fastened together by welding.

The three shelf dividers 12, 13, 14 are similar in structure but have different heights. Therefore, one shelf divider 14 is taken as an example for explanation. The shelf divider 14 comprises two classification rod members 18, 19 and two transverse rod members 20, 21. The classification rod member 18 is bent to form a horizontal top portion 22*a*, two vertical lateral portions 23*a*, 23*b*, and two hooked end portions 25*a*, 25*b*. The horizontal top portion 22*a* is disposed at top ends of the vertical lateral portions 23*a*, 23*b*. The two vertical lateral portions 23*a*, 23*b* are disposed opposite to each other. Further, the two vertical lateral portions 23*a*, 23*b* have the same height. The two hooked end portions 25*a*, 25*b* are respectively extended from respective opposing bottom ends of the vertical lateral portions 23*a*, 23*b*.

The classification rod member 19 is bent to form a horizontal top portion 22*b*, two vertical lateral portions 24*a*, 24*b*, and two hooked end portions 26*a*, 26*b*. The structure and shape of the classification rod member 19 are substantially similar to the classification rod member 18. Further, the length L1 of the horizontal top portion 22*b* is slightly shorter than the distance L2 between two outsides of the two support rod members 15, 16, so that the shelf dividers 12, 13, 14 can impart a pressure to the two support rod members 15, 16 to force the two support rod members 15, 16 in direction toward each other.

The transverse rod member 20 is connected between respective bottom ends of the vertical lateral portions 23*a*, 24*a* of the classification rod members 18, 19 adjacent to the hooked end portions 25*a*, 26*a*. The transverse rod member 21 is connected between respective bottom ends of the vertical lateral portions 23*b*, 24*b* of the classification rod members 18, 19 adjacent to the hooked end portions 25*b*, 26*b*. The two transverse rod members 20, 21 are preferably fastened to the classification rod members 18, 19 by welding.

Based on the above description we can see that an accommodation open space is defined between the classification rod members 18, 19 of the shelf divider 14 for holding documents, magazines, books, newspapers, and other classified items. Further, in this embodiment, an accommodation open space is also defined between each two adjacent ones of the shelf dividers 12, 13, 14 for storing documents, foods, canned beverages and other articles.

Figure 3:
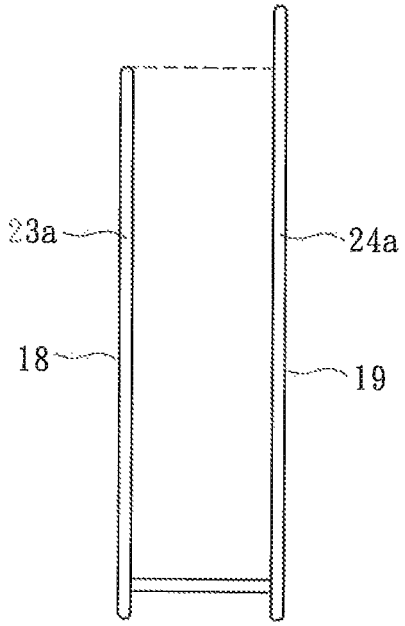
FIG. 3 is a side view of one shelf divider of the combination classification shelf shown in FIG. 1.

Referring to FIG. 3, the major difference between the two classification rod members 18, 19 is that the height of the vertical lateral portion 24*a* is greater than the height of the vertical lateral portion 23*a* for classifying different heights of documents.

Figure 4:
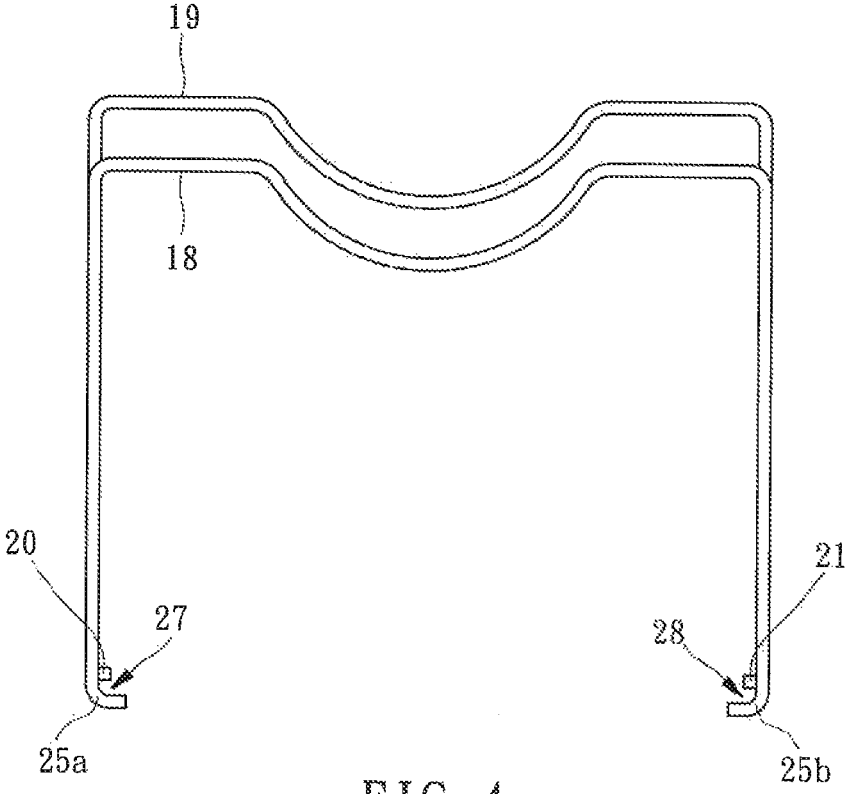
FIG. 4 is a front view of one shelf divider of the combination classification shelf FIG. 1.

Referring to FIG. 4, the transverse rod member 20 is connected between the hooked end portions 25*a*, 26*a* of the classification rod members 18, 19 so that the transverse rod member 20 defines with the hooked end portions 25*a*, 26*a* a receiving space 27, the transverse rod member 21 is connected between the hooked end portions 25*b*, 26*b* of the classification rod members 18, 19 so that the transverse rod member 20 defines with the hooked end portions 25*b*, 26*b* a receiving space 28. It is to be noted that due to the angle of view in FIG. 3, the hooked end portions 26*a*, 26*b* are not illustrated. Further, the receiving spaces 27, 28 have the respective open sides facing toward each other.

Figure 5:
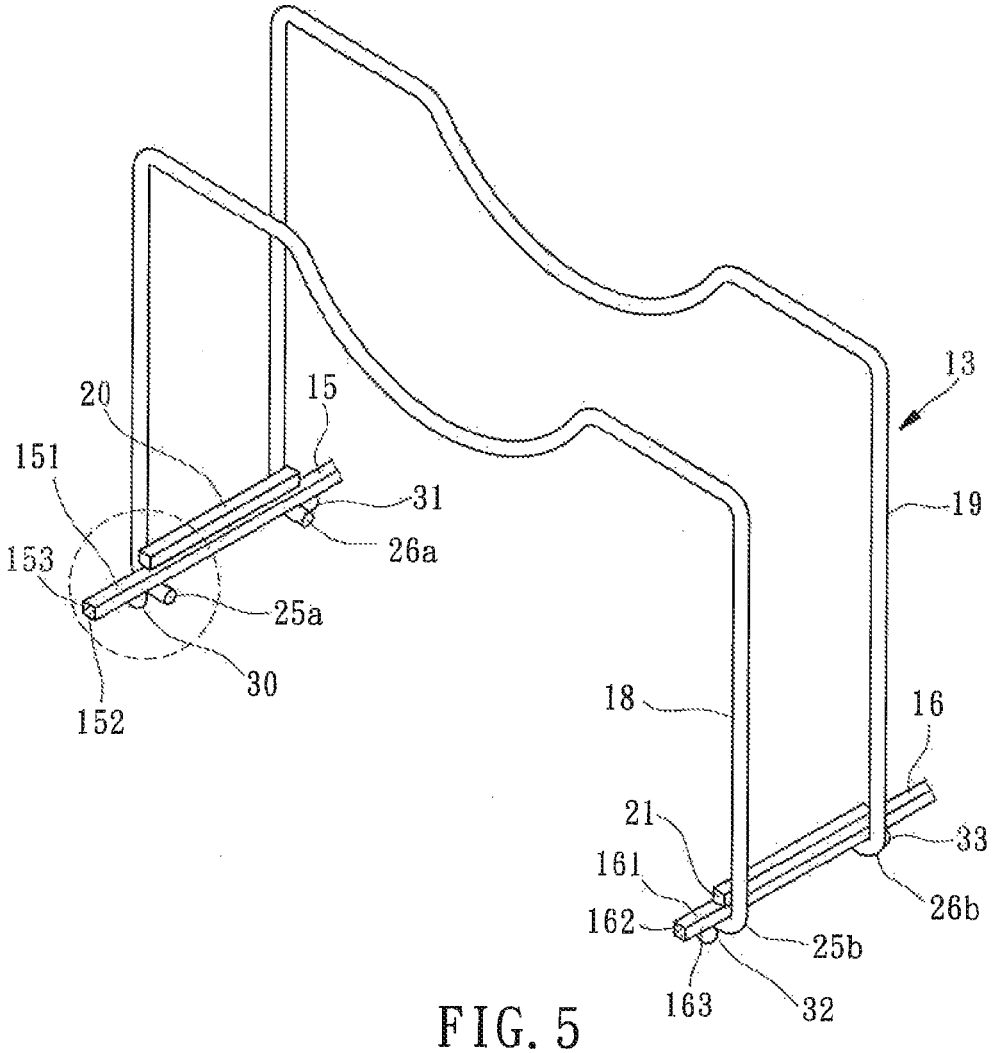
FIG. 5 is an enlarged view of a part of the combination classification shelf shown in FIG. 2.
Figure 6:
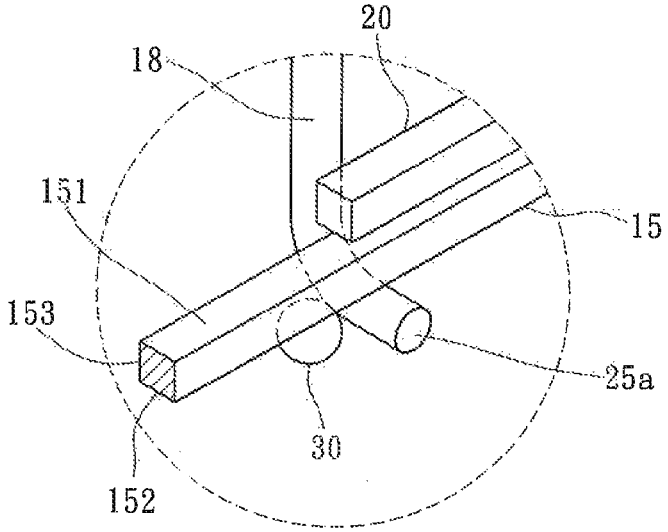
FIG. 6 is an enlarged view of a part of the combination classification shelf shown in FIG. 5.

Referring to FIGS. 5 and 6, the two receiving spaces 27, 28 of the shelf divider 13 are adapted for receiving the support rod members 15, 16 respectively. The two transverse rod members 20, 21 are respectively stopped at the top surfaces 151, 161 of the two support rod members 15, 16. The hooked end portions 25*a*, 25*b*, 26*a*, 26*b* are respectively attached to the outer surfaces 153, 163 and bottom surfaces 152, 162 of the two support rod members 15, 16. Thus, the shelf divider 13 can be stably mounted at the support rod members 15, 16.

More particularly, the support rod members 15, 16 and the transverse rod members 20, 21 are square rods. Thus, the transverse rod members 20, 21 can be respectively kept in surface-to-surface contact with the support rod members 15, 16, and positively supported on the support rod members 15, 16. In actual practice, the support rod members 15, 16 and the transverse rod members 20, 21 can also be selected from square tubes, round rods and round tubes, and therefore the use of square rods is not a limitation.

Preferably, the base frame 11 further comprises four stop elements 30, 31, 32, 33. These stop elements 30, 31, 32, 33 are connected to the support rod members 15, 16 and located at the bottom surfaces 152, 162 of the support rod members 15, 16. In this embodiment, these stop elements 30, 31, 32, 33 are metal balls preferably bonded to the support rod members 15, 16 by welding. However, the use of metal balls is not a limitation, for example, these stop elements 30, 31, 32, 33 can be metal blocks.

Figure 7:
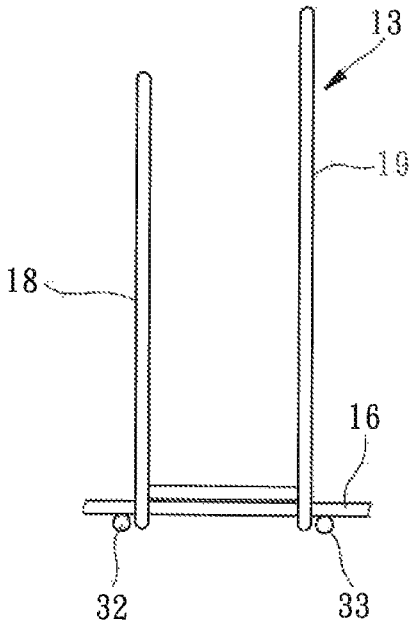
FIG. 7 is a side view of the combination classification shelf shown in FIG. 5.

Referring to FIG. 7, the distance between the stop elements 32, 33 is slightly larger than the distance between the classification rod members 18, 19, enabling the shelf divider 13 to be mounted between the stop elements 32, 33. Further, the stop elements 32, 33 can stop the classification rod members 18, 19 from moving along the support rod member 16, i.e., the shelf divider 13 is prohibited from moving along the support rod members 15, 16 after having been mounted at the support rod members 15, 16.

Figure 8:
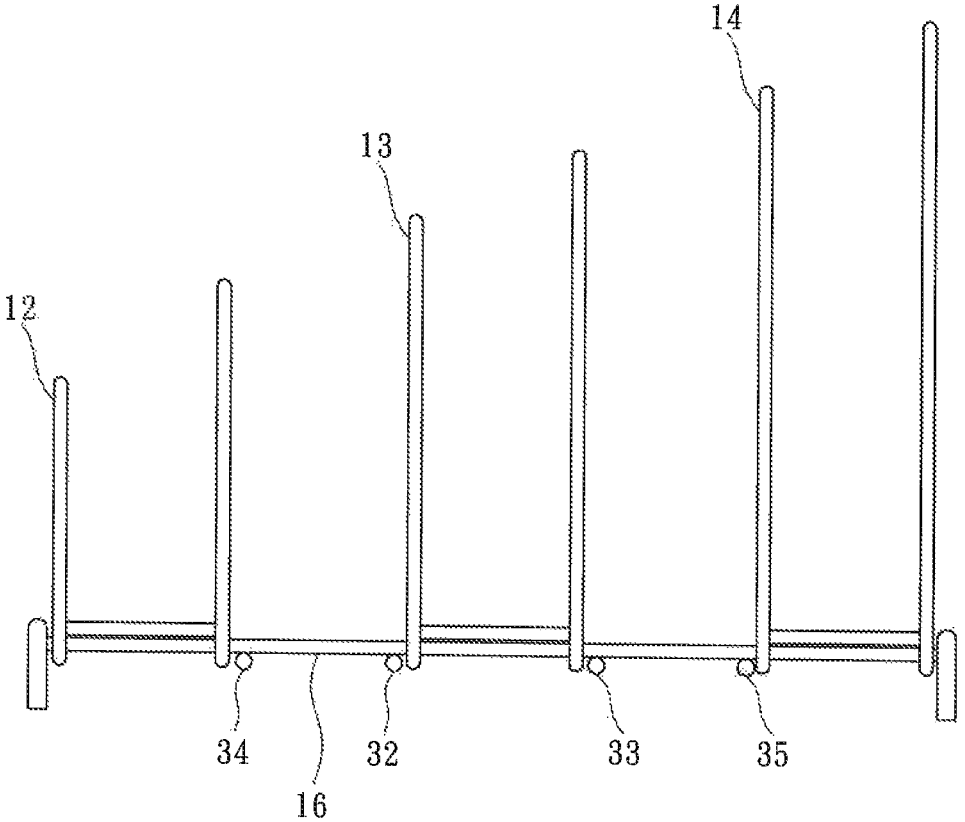
FIG. 8 is a side view of the combination classification shelf shown in FIG. 2.

Referring to FIG. 8, in addition to the aforesaid stop elements 30, 31, 32, 33, the base frame 11 further comprises other two stop elements 34, 35. These two stop elements 34, 35 are connected to the support rod member 16, and adapted to stop the shelf dividers 12, 14 from moving along the support rod member 16.

From what is shown in FIGS. 5-8, it can be known that the above-described stop elements are adapted to stop the shelf dividers from moving along the support rod members. Thus, the arrangement of the stop elements can have a lot of options, for example, these stop elements can be arranged at the inner side of the classification rod members, or two stop elements can be arranged at two opposite lateral sides of the hooked end portions of one classification rod member. Further, the number of the stop elements is not limited to the illustrated four stop elements. Therefore, the mounting locations and number of the stop elements are not limited to that shown in the drawings.

Figure 9:
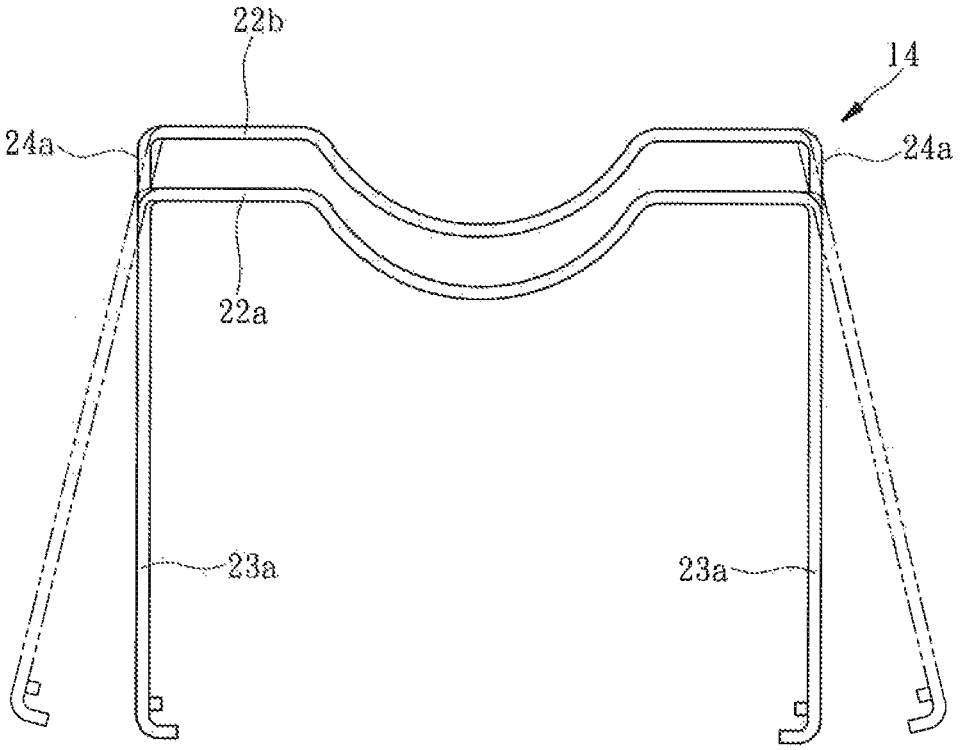
FIG. 9 is a schematic drawing illustrating one shelf divider of the combination classification shelf of FIG. 1 elastically deformed by force.

Further, the shelf dividers 12, 13, 14 are elastic, as illustrated in FIG. 9 where the shelf divider 14 is taken as an example for explanation. The vertical lateral portions 23*a*, 23*b*, 24*a*, 24*b* of the shelf divider 14 are elastically movable by an external force to tilt relative to the horizontal top portions 22*a*, 22*b*, as shown by the dotted lines. When the external force disappeared, these vertical lateral portions 23*a*, 23*b*, 24*a*, 24*b* immediately return to their former shape subject to their elastic material property, as shown by the solid lines. Thus, based on the elastic material property, the classification rods 12, 13, 14 can easily be mounted at the support rod members 15, 16.

Figure 10:
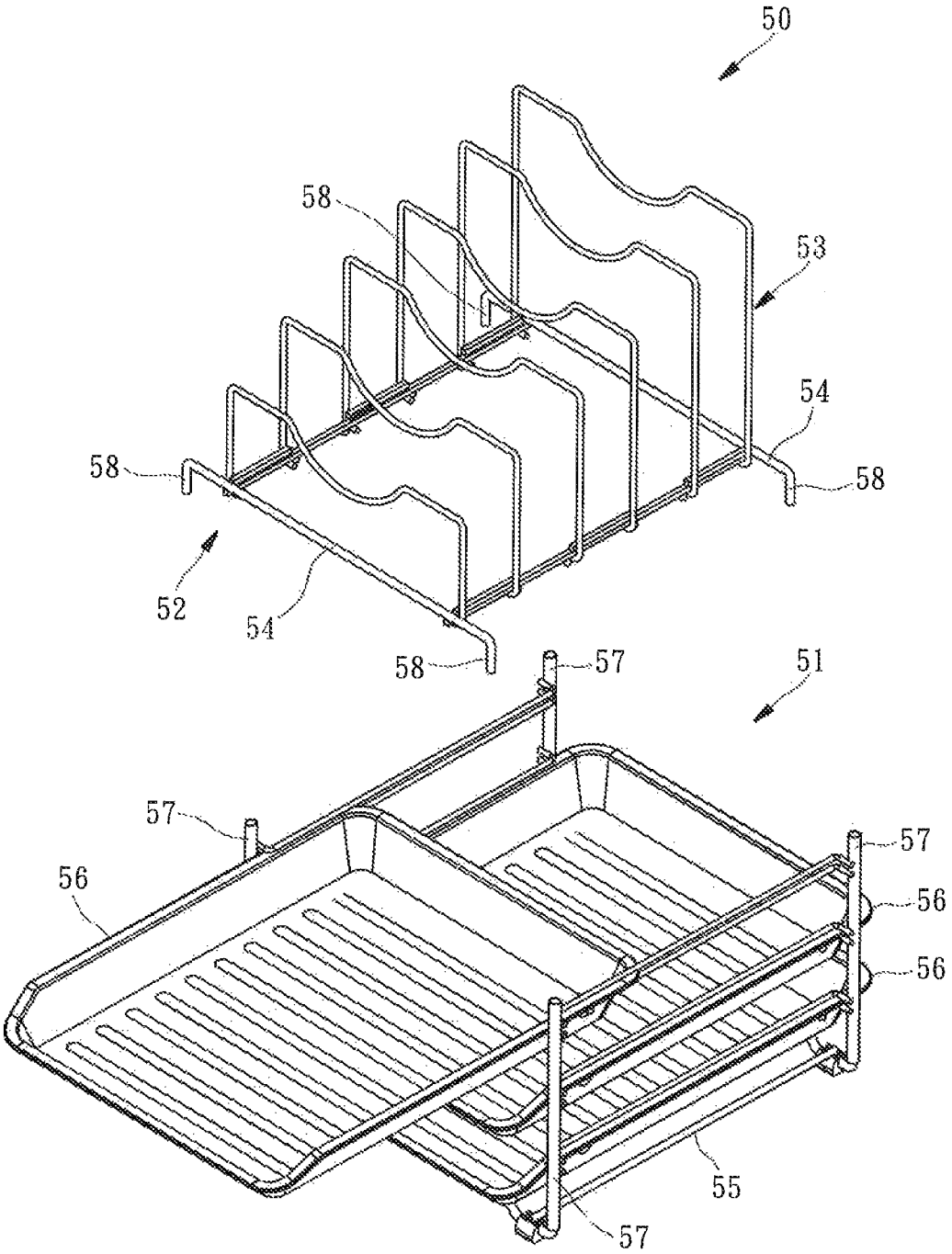
FIG. 10 is an exploded view of a combination classification shelf in accordance with a second embodiment of the present invention.
Figure 11:
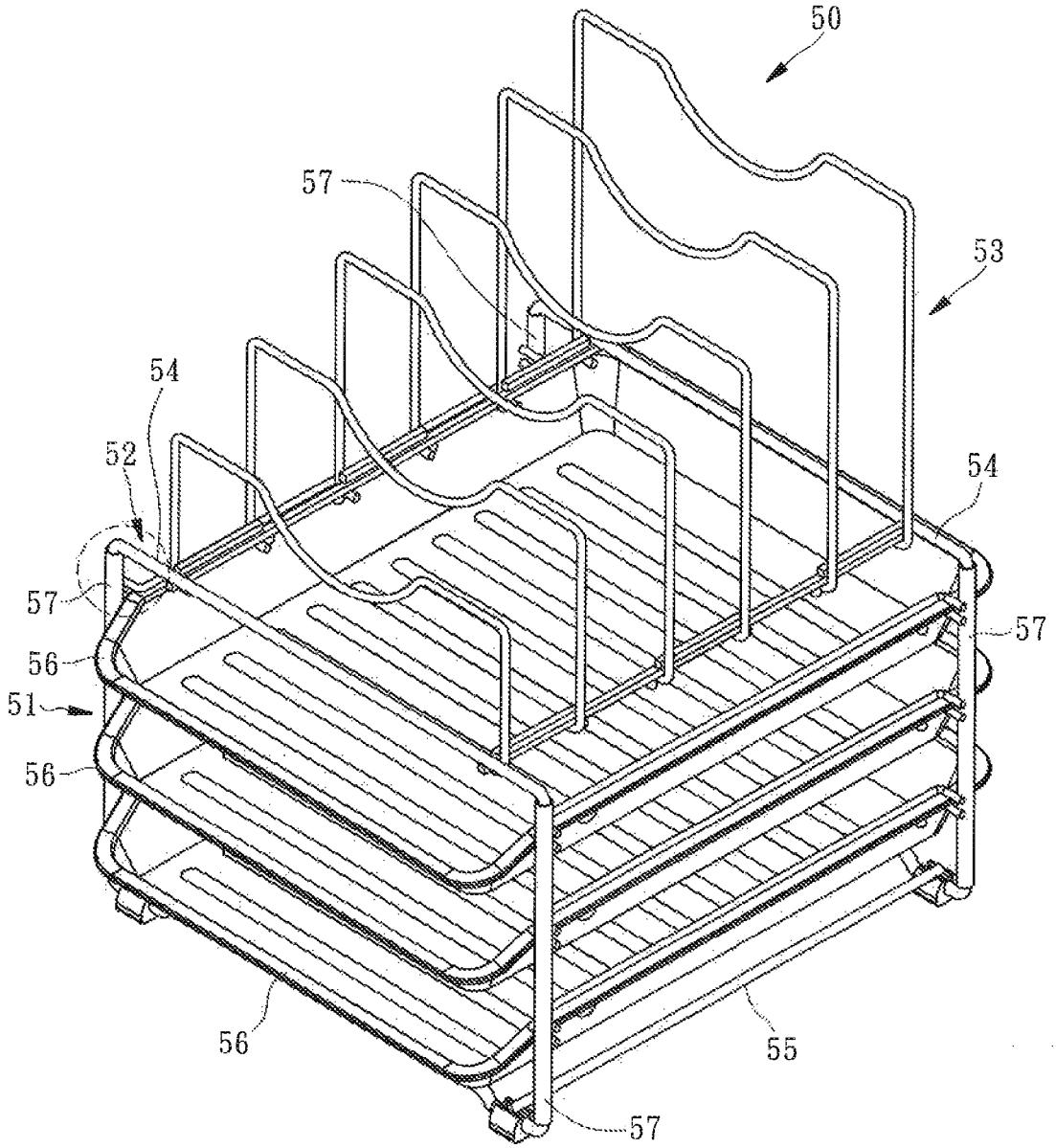
FIG. 11 is an elevational assembly view of the combination classification shelf shown in FIG. 10.
Figure 12:
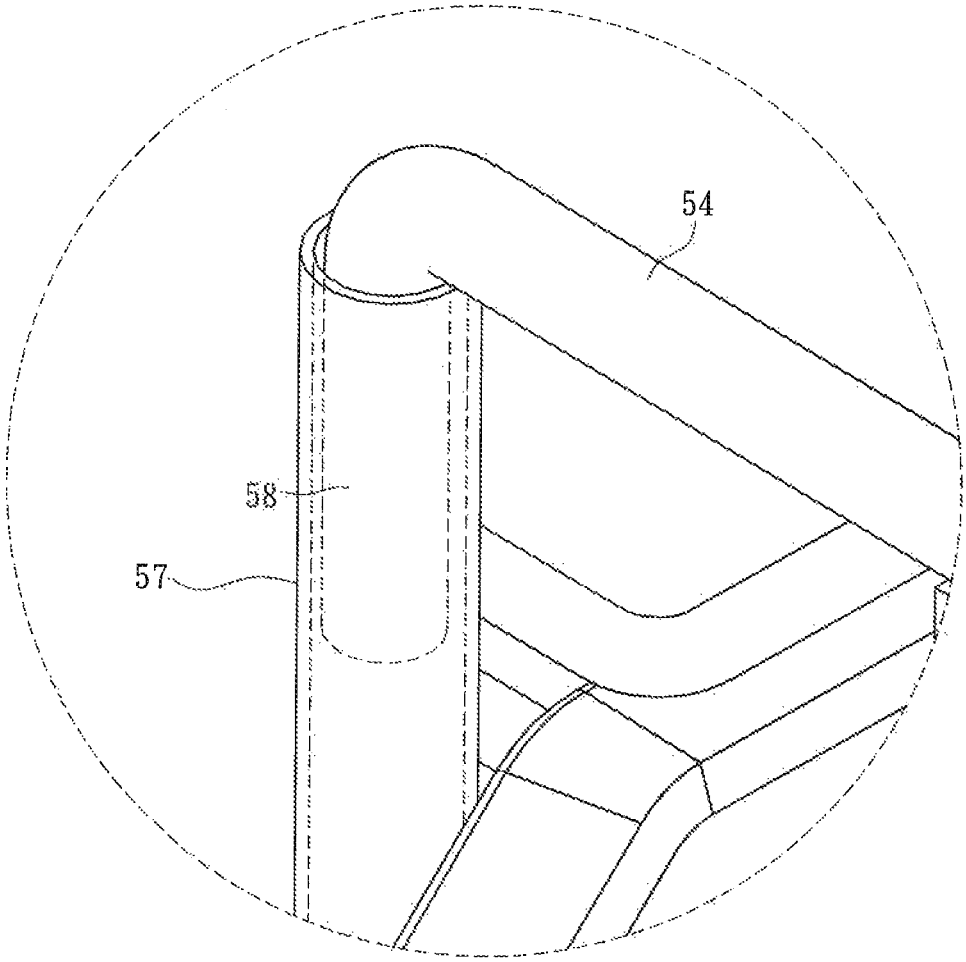
FIG. 12 is an enlarged view of a part of the combination classification shelf shown in FIG. 11.

Referring to FIGS. 10-12, a combination classification shelf 50 in accordance with a second embodiment of the present invention is shown. In addition to the aforesaid base frame and shelf dividers, this combination classification shelf 50 further comprises a drawer assembly 51. The structures and configurations of the base frame 52 and shelf dividers 53 of the combination classification shelve 50 and their mounting arrangement are same as the aforesaid first embodiment, and thus no further detailed description in this regard will be given. The two connection rod members 54 of the base frame 52 are adapted for mounting at the drawer assembly 51.

The drawer assembly 51 comprises a drawer holder 55 and three basket drawers 56. The drawer holder 55 comprises four upright support tubes 57. The basket drawers 56 are respectively mounted in the drawer holder 55 between the upright support tubes 57 at different elevations, and slidable relative to the drawer holder 55.

Each connection rod member 54 has two opposite ends thereof bent in one direction through a predetermined angle, forming one respective free end portion 58. The free end portions 58 of the two connection rod members 54 are respectively plugged into the upright support tubes 57, and thus the drawer assembly 51, the base frame 52 and the shelf dividers 53 are assembled together.

In conclusion, the combination classification shelf of the invention can be selectively made subject to one of the aforesaid two embodiments, and the number of the shelf dividers can be increased or reduced as desired, however at least one shelf divider must be provided. Further, the drawer assembly is not limited to the illustrated three-level design, i.e., it can be a single level, two-level design, or a design more than three levels.

What is claimed is:

1. A combination classification shelf for holding files and documents, comprising:

a base frame comprising two support rod members transversely arranged in parallel and kept apart from each other at a distance; and at least one shelf divider detachably mounted at said base frame, each said shelf divider comprising two classification rod members and two transverse rod members, each said classification rod member bent to form a horizontal top portion, two vertical lateral portions and two hooked end portions, each horizontal top portion being disposed at top ends of the respective vertical lateral portions, said respective vertical lateral portions being disposed opposite to each other, said hooked end portions being respectively disposed at bottom ends of said vertical lateral portions, said two transverse rod members of each divider being respectively connected between respective bottom ends of the vertical lateral portions of said classification rod members adjacent to said hooked end portions of a corresponding divider, each said transverse rod member defining with the respective said hooked end portions a receiving space, each support rod member being respectively received in a corresponding receiving space, each transverse rod member being respectively stopped at a respective top surface of a corresponding support rod member; wherein said base frame further comprises a plurality of stop elements respectively connected to said two support rod members and adapted to stop each shelf divider from sliding relative to said support rod members; and said base frame comprises two connection rod members longitudinally arranged in parallel and connected to said support rod members, each said connection rod member having two opposite ends thereof bent to form a respective vertical free end portion, wherein each vertical free end portion is adapted to be mounted within a corresponding upright support tube of a drawer assembly.

2. The combination classification shelf as claimed in claim 1, wherein said two support rod members are square rods, said two transverse rod members are square rods.

3. The combination classification shelf as claimed in claim 1, wherein said stop elements are respectively located at respective bottom surfaces of said two support rod members, and a distance between each two adjacent said stop elements is larger than a distance between said respective two classification rod members of each divider.

4. The combination classification shelf as claimed in claim 3, wherein the respective two receiving spaces of a corresponding divider each define an open side, and the open sides of said respective two receiving spaces face toward each other.

5. The combination classification shelf as claimed in claim 1, wherein a length of the vertical lateral portions of one of said two classification rod members of a corresponding divider is larger than a length of the vertical lateral portions of the other of said two classification rod members of the corresponding divider.

6. A combination classification shelf comprising:

a drawer assembly;

a base frame detachably mounted at said drawer assembly, said base frame comprising two support rod members transversely arranged in parallel and kept apart from each other at a distance; and at least one shelf divider detachably mounted at said base frame, each said shelf divider comprising two classification rod members and two transverse rod members, each said classification rod member bent to form a horizontal top portion, two vertical lateral portions and two hooked end portions, each horizontal top portion being disposed at top ends of the respective vertical lateral portions, said respective vertical lateral portions being disposed opposite to each other, said hooked end portions being respectively disposed at bottom ends of said vertical lateral portions, said two transverse rod members of each divider being respectively connected between respective bottom ends of the vertical lateral portions of said classification rod members adjacent to said hooked end portions of a corresponding divider, each said transverse rod member defining with the respective said hooked end portions a receiving space, each support rod member being respectively received in a corresponding receiving space, each transverse rod member being respectively stopped at a respective top surface of a corresponding support rod member; wherein said drawer assembly comprises four upright support tubes; said base frame further comprises two connection rod members longitudinally arranged in parallel and connected to said support rod members, each said connection rod member having two opposite ends thereof bent to form one respective free end portion, the free end portions of said two connection rod members being respectively plugged into said four upright support tubes to support each shelf divider above the drawer assembly.

7. The combination classification shelf as claimed in claim 6, wherein said two support rod members are square rods, said two transverse rod members are square rods.

8. The combination classification shelf as claimed in claim 6, wherein said base frame further comprises a plurality of stop elements respectively connected to said two support rod members and adapted to stop each shelf divider from sliding relative to said support rod members.

9. The combination classification shelf as claimed in claim 8, wherein said stop elements are respectively located at respective bottom surfaces of said two support rod members, and a distance between each two adjacent said stop elements is larger than a distance between said respective two classification rod members of each divider.

10. The combination classification shelf as claimed in claim 3, wherein the respective two receiving spaces of a corresponding divider each define an open side, and the open sides of said respective two receiving spaces face toward each other.

11. The combination classification shelf as claimed in claim 1, wherein a length of the vertical lateral portions of one of said two classification rod members of a corresponding divider is larger than a length of the vertical lateral portions of the other of said two classification rod members of the corresponding divider.

* * * * *